US010276913B2

(12) United States Patent
Goto

(10) Patent No.: US 10,276,913 B2
(45) Date of Patent: Apr. 30, 2019

(54) DIRECTIONAL COUPLER

(71) Applicant: TDK Corporation, Tokyo (JP)

(72) Inventor: Tetsuzo Goto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 63 days.

(21) Appl. No.: 15/787,061

(22) Filed: Oct. 18, 2017

(65) Prior Publication Data

US 2018/0123215 A1 May 3, 2018

(30) Foreign Application Priority Data

Oct. 31, 2016 (JP) ..... 2016-213468

(51) Int. Cl.
*H01P 5/18* (2006.01)

(52) U.S. Cl.
CPC ..... *H01P 5/184* (2013.01); *H01P 5/187* (2013.01)

(58) Field of Classification Search
CPC ..... H01P 5/18; H01P 5/184; H01P 5/187
USPC ..... 333/109–112
See application file for complete search history.

(56) References Cited

U.S. PATENT DOCUMENTS

| | | | | |
|---|---|---|---|---|
| 7,042,309 | B2 * | 5/2006 | Podell | H01P 5/187 333/112 |
| 9,077,061 | B2 * | 7/2015 | Tamaru | H01P 5/184 |
| 9,184,485 | B2 * | 11/2015 | Yoshioka | H01P 5/187 |
| 9,653,771 | B2 * | 5/2017 | Ootsuka | H01P 5/184 |
| 9,893,407 | B2 * | 2/2018 | Ootsuka | H01P 5/18 |
| 9,893,408 | B2 * | 2/2018 | Ashida | H01P 5/18 |
| 10,084,225 | B2 * | 9/2018 | Ashida | H01P 5/18 |
| 2012/0319797 | A1 | 12/2012 | Tamaru | |
| 2018/0123214 | A1 * | 5/2018 | Goto | H01P 5/187 |

FOREIGN PATENT DOCUMENTS

JP 2013-005076 A 1/2013

* cited by examiner

*Primary Examiner* — Dean O Takaoka
(74) *Attorney, Agent, or Firm* — Oliff PLC

(57) ABSTRACT

The element body includes a main line; a first sub line and a second sub line; a pair of ground layers that are disposed to face each other at positions at which the main line, the first sub line, and the second sub line are interposed in a stacking direction of the plurality of insulator layers; a phase control circuit that is connected between the first sub line and the second sub line and is disposed at a position at which one ground layer is interposed between the first sub line and the second sub line in the stacking direction; and a connection line that connects the first sub line and the second sub line to the phase control circuit. The connection line is surrounded by at least one of one ground layer and a conductor having the same potential as the ground layer when viewed in the stacking direction.

4 Claims, 10 Drawing Sheets

DIRECTIONAL COUPLER

TECHNICAL FIELD

The present invention relates to a directional coupler.

BACKGROUND

For example, a directional coupler described in Japanese Unexamined Patent Publication No. 2013-5076 is known in the related art. The directional coupler described in Japanese Unexamined Patent Publication No. 2013-5076 includes first to fourth terminals, a main line that is connected between the first terminal and the second terminal, a first sub line that is connected to the third terminal and is electromagnetically coupled to the main line, a second sub line that is connected to the fourth terminal and is electromagnetically coupled to the main line, and a phase conversion unit that is connected between the first sub line and the second sub line and causes a phase difference in a passing signal. In the directional coupler, the main line, the first sub line, and the second sub line are disposed between a pair of ground layers which are connected to the ground.

SUMMARY

As in the directional coupler according to the related art, a phase control circuit is connected between the first sub line and the second sub line. The phase control circuit is disposed at a position at which one ground layer is interposed between the first sub line and the second sub line in an opposing direction of the pair of ground layers. Accordingly, connection lines that connect the first sub line and the second sub line to the phase control circuit are connected to the first sub line and the second sub line, for example, through cutout portions formed in the ground layers. In this configuration, since a part of the connection line and the ground layer oppose each other (a part of the connection line does not oppose the ground layer) when viewed in the opposing direction of the pair of ground layers, a difference in impedance may be generated in the connection lines. As a result, there is concern that isolation characteristics will deteriorate.

An aspect of the invention provides a directional coupler that can achieve improvement in isolation characteristics.

According to an aspect of the invention, there is provided a directional coupler including: an element body that is formed by stacking a plurality of insulator layers; and an input terminal and an output terminal that are disposed on an outer surface of the element body. The element body includes a main line that is connected between the input terminal and the output terminal, a first sub line and a second sub line that are electromagnetically coupled to the main line, a pair of ground layers that are disposed to face each other at positions at which the main line, the first sub line, and the second sub line are interposed in a stacking direction of the plurality of insulator layers, a phase control circuit that is connected between the first sub line and the second sub line and is disposed at a position at which one ground layer is interposed between the first sub line and the second sub line in the stacking direction, and a connection line that connects the first sub line and the second sub line to the phase control circuit. The connection line is surrounded by at least one of one ground layer and a conductor having the same potential as the ground layer when viewed in the stacking direction.

In the directional coupler according to one aspect of the invention, the connection line is surrounded at a position of one ground layer by at least one of one ground layer and a conductor having the same potential as the ground layer when viewed in the stacking direction. Accordingly, in the directional coupler, it is possible to prevent a difference in impedance from being generated in the connection line. Accordingly, according to the directional coupler, it is possible to achieve improvement in isolation characteristics.

In one aspect of the invention, a plurality of conductors may be disposed in the stacking direction. According to this configuration, the connection line can be surrounded by a plurality of conductors in an extending direction of the connection line. Accordingly, it is possible to further prevent a difference in impedance form being generated in the connection line.

In one aspect of the invention, a cutout portion may be formed in one ground layer, and the connection line may be disposed in an area which is defined by the cutout portion and is surrounded by the ground layer and the conductor when viewed in the stacking direction. According to this configuration, the connection line is disposed in an area which is defined by the cutout portion and the connection line is surrounded by the ground layer and the conductor. Accordingly, it is possible to satisfactorily surround the connection line. In the configuration, since the connection line is disposed in the area defined by the cutout portion, the connection line can be foamed to extend in the stacking direction. Accordingly, it is possible to achieve simplification of the configuration of the connection line.

In one aspect of the invention, the connection line may include a first line that connects the first sub line and the phase control circuit to each other and a second line that connects the second sub line and the phase control circuit to each other, and the first line and the second line may be surrounded by at least one of one ground layer and a conductor having the same potential as the ground layer. According to this configuration, it is possible to further prevent a difference in impedance from being generated in the first line and the second line.

According to the aspect of the invention, it is possible to achieve improvement in isolation characteristics.

DETAILED DESCRIPTION

Hereinafter, an exemplary embodiment of the invention will be described in detail with reference to the accompanying drawings. In description with reference to the drawings, the same or corresponding elements will be referenced by the same reference signs and description thereof will not be repeated.

Figure 1:
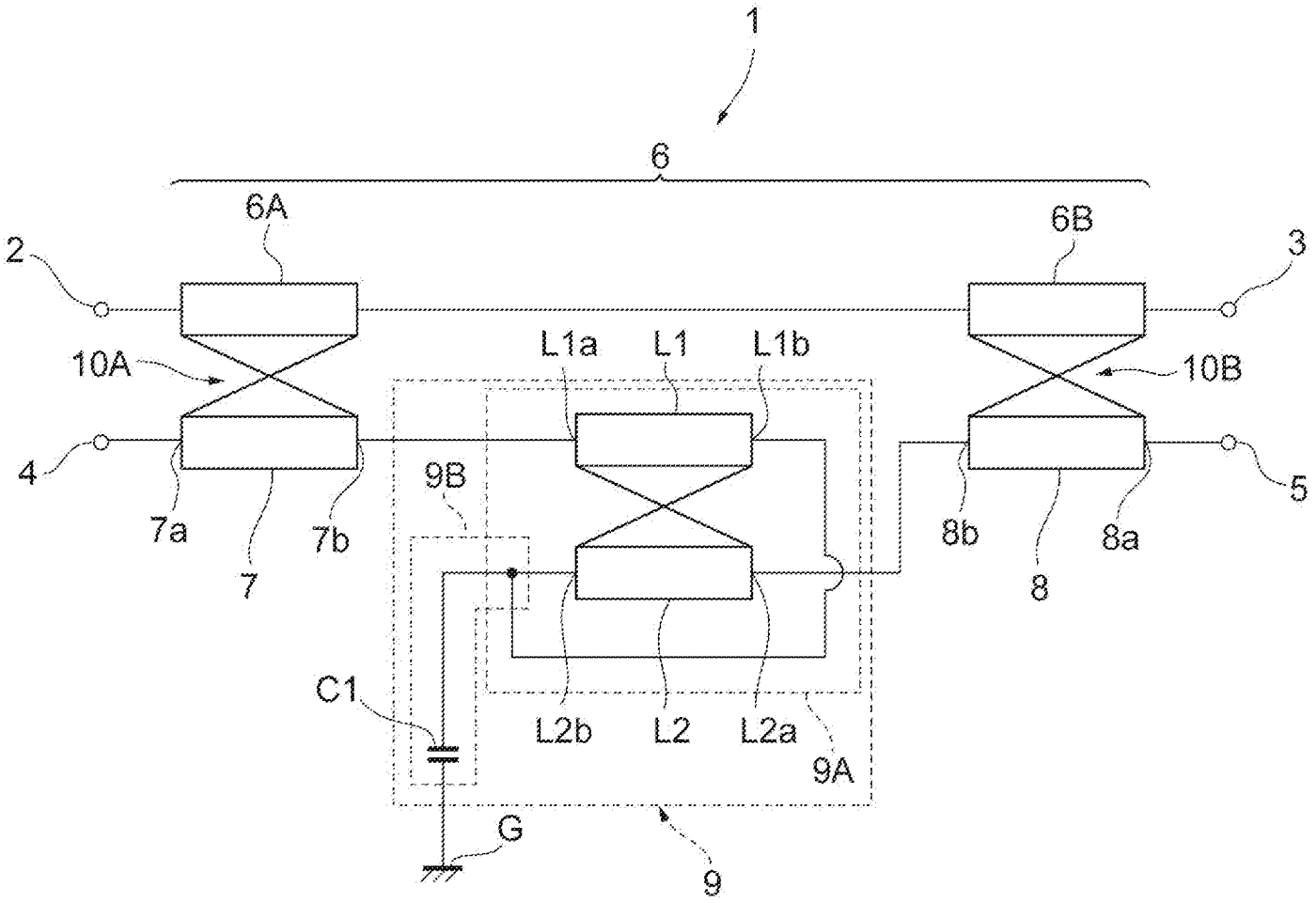
FIG. 1 is a diagram illustrating an equivalent circuit of a stacked coupler according to an embodiment.

As illustrated in FIG. 1, a stacked coupler (a directional coupler) 1 includes an input port (an input terminal) 2, an output port (an output terminal) 3, a coupling port 4, and a termination port 5. The stacked coupler 1 includes a main line 6 that is connected between the input port 2 and the output port 3, a first sub line 7 and a second sub line 8 that are electromagnetically coupled to the main line 6, and a phase control circuit 9 that is connected between the first sub line 7 and the second sub line 8.

The main line 6 includes a first portion 6A that is electromagnetically coupled to the first sub line 7 and a second portion 6B that is electromagnetically coupled to the second sub line 8. A portion in which the first portion 6A and the first sub line 7 are coupled to each other is referred to as a first coupling portion 10A. A portion in which the second portion 6B and the second sub line 8 are coupled to each other is referred to as a second coupling portion 10B. The first sub line 7 includes a first end 7*a* and a second end 7*b*. The first end 7*a* is electrically connected to the coupling port 4. The second sub line 8 includes a first end 8*a* and a second end 8*b*. The first end 8*a* is electrically connected to the termination port 5.

The phase control circuit 9 includes a first path 9A that electrically connects the first sub line 7 and the second sub line 8 to each other and a second path 9B that connects the first path 9A to the ground G. The first path 9A includes a first inductor L1 and a second inductor L2. The second path 9B includes a capacitor C1.

The first inductor L1 includes a first end L1*a* and a second end L1*b*. The second inductor L2 includes a first end L2*a* and a second end L2*b*. The first end L1*a* of the first inductor L1 is electrically connected to the second end 7*b* of the first sub line 7. The second end L1*b* of the first inductor L1 is electrically connected to the second end L2*b* of the second inductor L2. The first end L2*a* of the second inductor L2 is electrically connected to the second end 8*b* of the second sub line 8.

In the stacked coupler 1, a high-frequency signal is input from the input port 2 and the high-frequency signal is output from the output port 3. The coupling port 4 outputs a coupling signal with electric power corresponding to the high-frequency signal input to the input port 2.

A first signal path passing through the first coupling portion 10A and a second signal path passing through the second coupling portion 10B and the phase control circuit 9 are formed between the input port 2 and the coupling port 4. When a high-frequency signal is input to the input port 2, the coupling signal output from the coupling port 4 is a signal obtained by synthesizing a signal passing through the first signal path and a signal passing through the second signal path. The signal passing through the first signal path and the signal passing through the second signal path have a phase difference. A degree of coupling of the stacked coupler 1 depends on independent degrees of coupling of the first coupling portion 10A and the second coupling portion 10B and a phase difference between the signal passing through the first signal path and the signal passing through the second signal path.

A third signal path passing through the first coupling portion 10A and a fourth signal path passing through the second coupling portion 10B and the phase control circuit 9 are formed between the output port 3 and the coupling port 4. Isolation of the stacked coupler 1 depends on the independent degrees of coupling of the first coupling portion 10A and the second coupling portion 10B and a phase difference between a signal passing through the third signal path and a signal passing through the fourth signal path. The first coupling portion 10A, the second coupling portion 10B, and the phase control circuit 9 have a function of preventing a variation in the degree of coupling of the stacked coupler 1 with a variation in frequency of a high-frequency signal.

Figure 2:
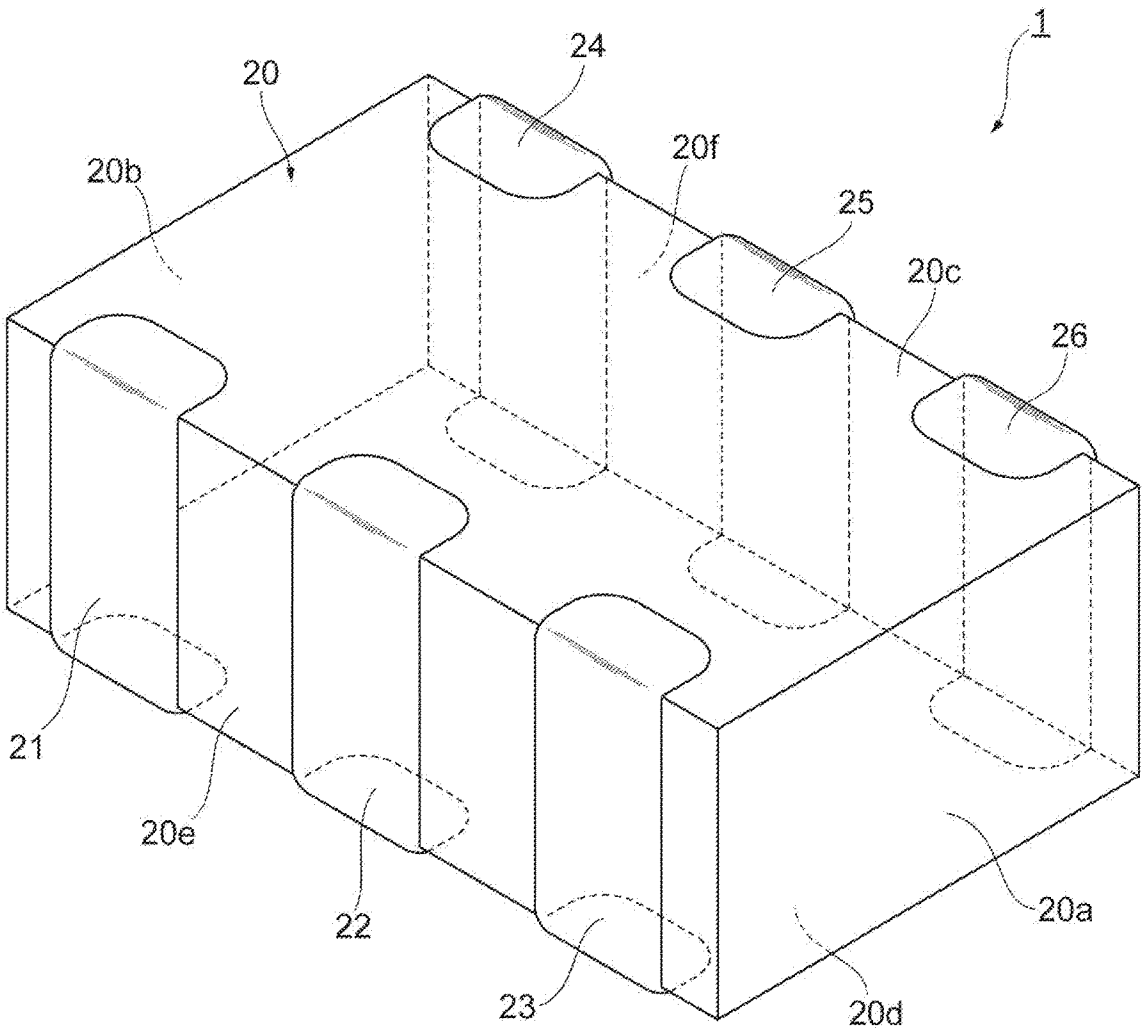
FIG. 2 is a perspective view illustrating the stacked coupler.

A structure of the stacked coupler 1 will be described below. As illustrated in FIG. 2, the stacked coupler 1 includes an element body 20, a first terminal electrode 21, a second terminal electrode 22, a third terminal electrode 23, a fourth terminal electrode 24, a fifth terminal electrode 25, and a sixth terminal electrode 26.

The element body 20 has a rectangular parallelepiped shape. The element body 20 has, as outer faces thereof, a pair of end faces 20*a* and 20*b* that face each other, a pair of principal faces 20*c* and 20*d* that extend to connect the pair of end faces 20*a* and 20*b* to each other and face each other, and a pair of lateral faces 20*e* and 20*f* that extend to connect the pair of principal faces 20*c* and 20*d* and face each other. The principal face 20*d* is defined as a surface facing another electronic device, for example, the stacked coupler 1 is mounted on another electronic device (for example, a circuit board or an electronic component) which is not illustrated.

The opposing direction of the end faces 20*a* and 20*b*, the opposing direction of the principal faces 20*c* and 20*d*, and the opposing direction of the lateral faces 20*e* and 20*f* are substantially perpendicular to each other. The rectangular parallelepiped shape includes a rectangular parallelepiped shape of which corners and edges are chamfered and a rectangular parallelepiped shape of which corners and edges are rounded.

Figure 3:
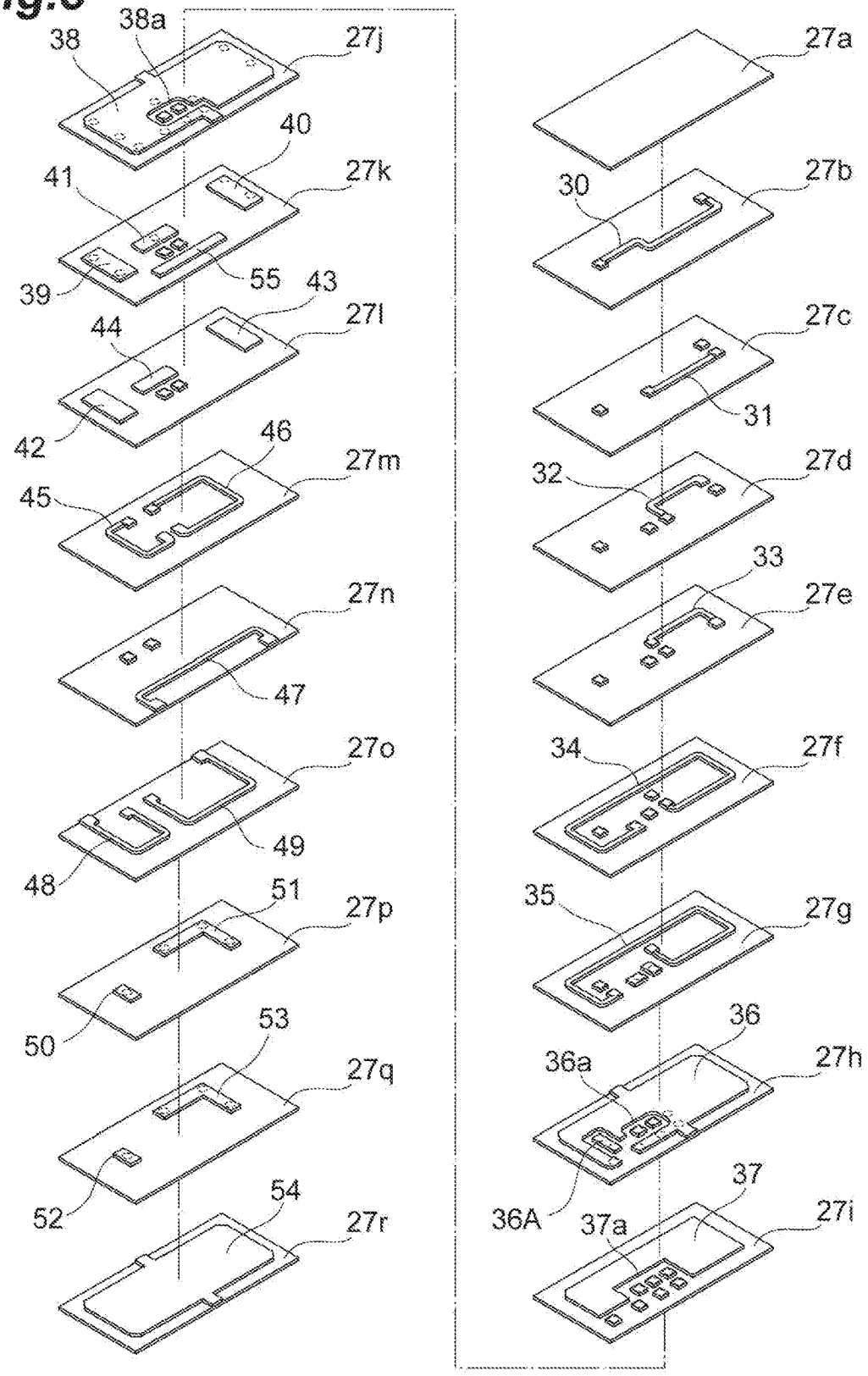
FIG. 3 is an exploded perspective view of an element body.

The element body 20 is formed by stacking a plurality of insulator layers 27 (27*a* to 27*r*) (see FIG. 3). The insulator layers 27 are stacked in the opposing direction of the principal faces 20*c* and 20*d* of the element body 20. That is, the stacking direction of the insulator layers 27 matches the opposing direction of the principal faces 20*c* and 20*d* of the element body 20. Hereinafter, the opposing direction of the principal faces 20*c* and 20*d* is also referred to as the "stacking direction." Each insulator layer 27 has a substantially rectangular shape. The insulator layer 27*a* is an uppermost layer of the element body 20 and constitutes the principal face 20*c*. The insulator layer 27*r* is a lowermost layer of the element body 20 and constitutes the principal face 20*d*. In the actual element body 20, the insulator layers 27 are integrated such that boundaries between the layers are invisible.

Each insulator layer 27 is formed of, for example, a sintered body of a ceramic green sheet including a dielectric material (such as a $BaTiO_3$-based material, a $Ba(Ti, Zr)O_3$-based material, a $(Ba, Ca)TiO_3$-based material, a glass material, or an alumina material). In the actual element body 20, the insulator layers 27 are integrated such that boundaries between the layers are invisible.

The first terminal electrode 21, the second terminal electrode 22, and the third terminal electrode 23 are disposed on the lateral face 20*e* of the element body 20. The first terminal electrode 21, the second terminal electrode 22, and the third terminal electrode 23 are formed to cover a part of the lateral face 20*e* in the stacking direction of the element body 20 and are formed in a part of the principal face 20*c* and a part of the principal face 20*d*. The first terminal electrode 21 is located on the end face 20*b* side and the third terminal electrode 23 is located on the end face 20*a* side. The second terminal electrode 22 is located between the first terminal electrode 21 and the third terminal electrode 23.

The fourth terminal electrode 24, the fifth terminal electrode 25, and the sixth terminal electrode 26 are disposed on the lateral face 20*f* of the element body 20. The fourth terminal electrode 24, the fifth terminal electrode 25, and the sixth terminal electrode 26 are formed to cover a part of the lateral face 20*f* in the stacking direction of the element body 20 and are formed in a part of the principal face 20*c* and a part of the principal face 20*d*. The fourth terminal electrode 24 is located on the end face 20*b* side and the sixth terminal electrode 26 is located on the end face 20*a* side. The fifth terminal electrode 25 is located between the fourth terminal electrode 24 and the sixth terminal electrode 26.

The terminal electrodes 21 to 26 include a conductive material (for example, Ag or Pd). Each of the terminal electrodes 21 to 26 is formed as a sintered body of a conductive paste including a conductive material (for example, Ag powder or Pd powder). A plated layer is formed on the surfaces of the terminal electrodes 21 to 26. The plated layer is formed, for example, by electroplating. The plated layer has a layered structure including a Cu-plated layer, a Ni-plated layer, and a Sn-plated layer or a layered structure including a Ni-plated layer and a Sn-plated layer.

In this embodiment, the first terminal electrode 21 constitutes the input port 2. The second terminal electrode 22 constitutes the ground G. The third terminal electrode 23 constitutes the output port 3. The fourth terminal electrode 24 constitutes the coupling port 4. The fifth terminal electrode 25 constitutes the ground G. The sixth terminal electrode 26 constitutes the termination port 5.

As illustrated in FIG. 3, a conductor layer 30, a conductor layer 31, a conductor layer 32, a conductor layer 33, a conductor layer 34, a conductor layer 35, a conductor layer 36, a conductor layer 36A, and a conductor layer 37 are formed on the insulator layers 27*b* to 27*i*. The conductor layer 36 and the conductor layer 36A are disposed on the same insulator layer 27*h*. The conductor layers 30 to 37 constitute a phase control circuit 9. The conductor layers 30 to 37 are formed of, for example, at least one of Ag and Pd as a conductive material. Each of the conductor layers 30 to 37 is formed as a sintered body of a conductive paste including at least one of Ag and Pd as a conductive material. In the following description, the conductors are formed in the same way.

Figure 4:
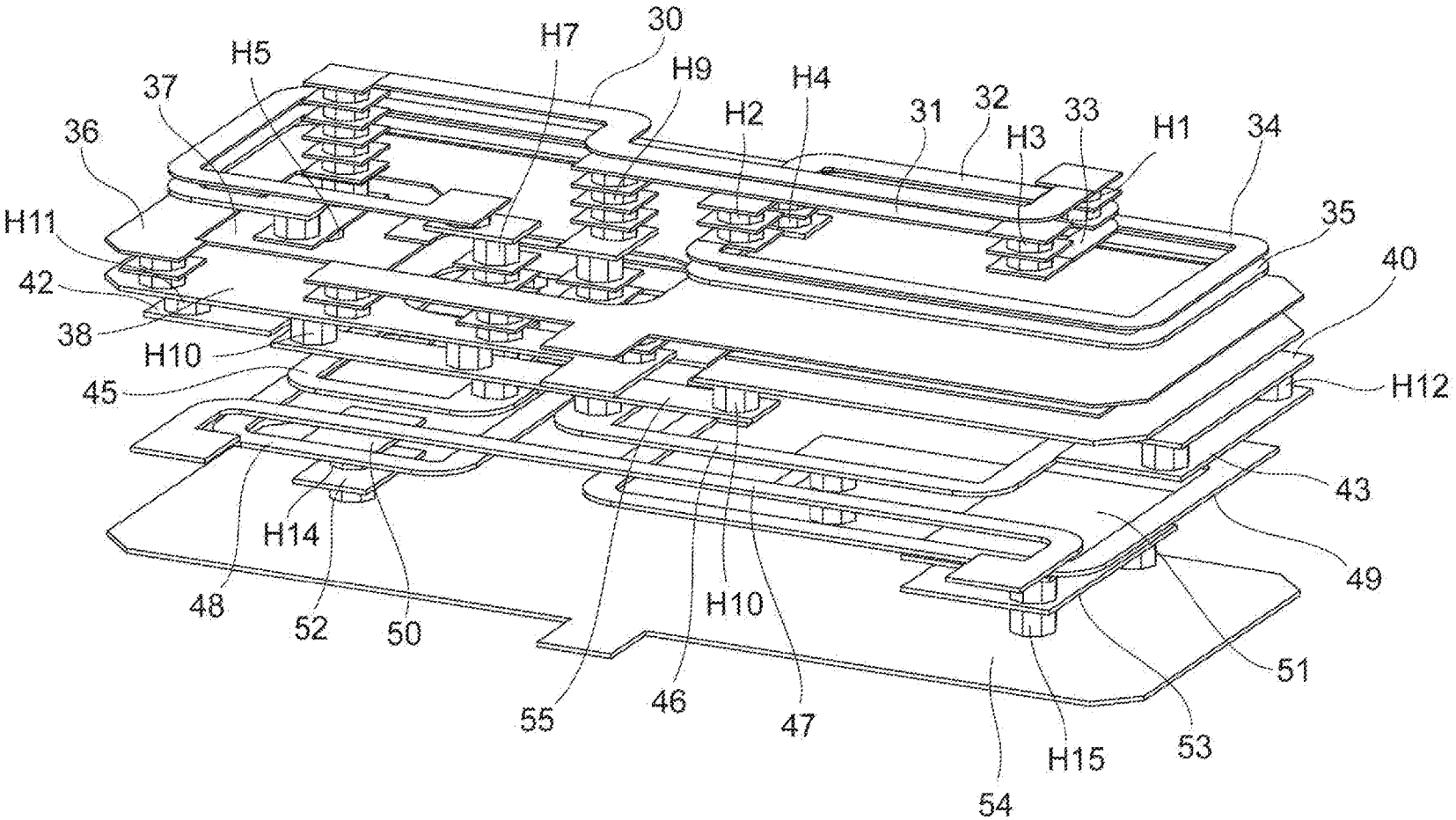
FIG. 4 is a perspective view illustrating an internal configuration of the element body.

The conductor layer 30, the conductor layer 32, and the conductor layer 34 constitute the first inductor L1. The conductor layer 30, the conductor layer 32, and the conductor layer 34 are electrically connected to each other via through-hole conductors H1 and H2 as illustrated in FIG. 4. One end of the conductor layer 30 constitutes the first end L1*a* of the first inductor L1. One end of the conductor layer 34 constitutes the second end L1*b* of the first inductor L1.

The conductor layer 31, the conductor layer 33, and the conductor layer 35 constitute the second inductor L2. The conductor layer 31, the conductor layer 33, and the conductor layer 35 are electrically connected to each other via through-hole conductors H3 and H4. One end of the conductor layer 35 constitutes the second end L2*b* of the second inductor L2. One end of the conductor layer 31 constitutes the first end L2*a* of the second inductor L2. The first inductor L1 and the second inductor L2 are electrically connected to each other via the conductor layer 36A. The conductor layer 36A is electrically connected to the conductor layer 37 via a through-hole conductor H5. The conductor layer 36 is electrically connected to the second terminal electrode 22 and the fifth terminal electrode 25. The conductor layer 36 and the conductor layer 37 constitute the capacitor C1.

A cutout portion 36*a* is formed in the conductor layer 36. A cutout portion 37*a* is formed in the conductor layer 37. A through-hole conductor H7 and a through-hole conductor H9 which will be described later are formed in areas defined by the cutout portion 36*a* and the cutout portion 37*a*, respectively.

As illustrated in FIG. 3, a conductor layer 47 is formed on the insulator layer 27*n*. The conductor layer 47 constitutes the main line 6. One end of the conductor layer 47 is electrically connected to the first terminal electrode 21 (the input port 2). The other end of the conductor layer 47 is electrically connected to the third terminal electrode 23 (the output port 3).

Figure 7:
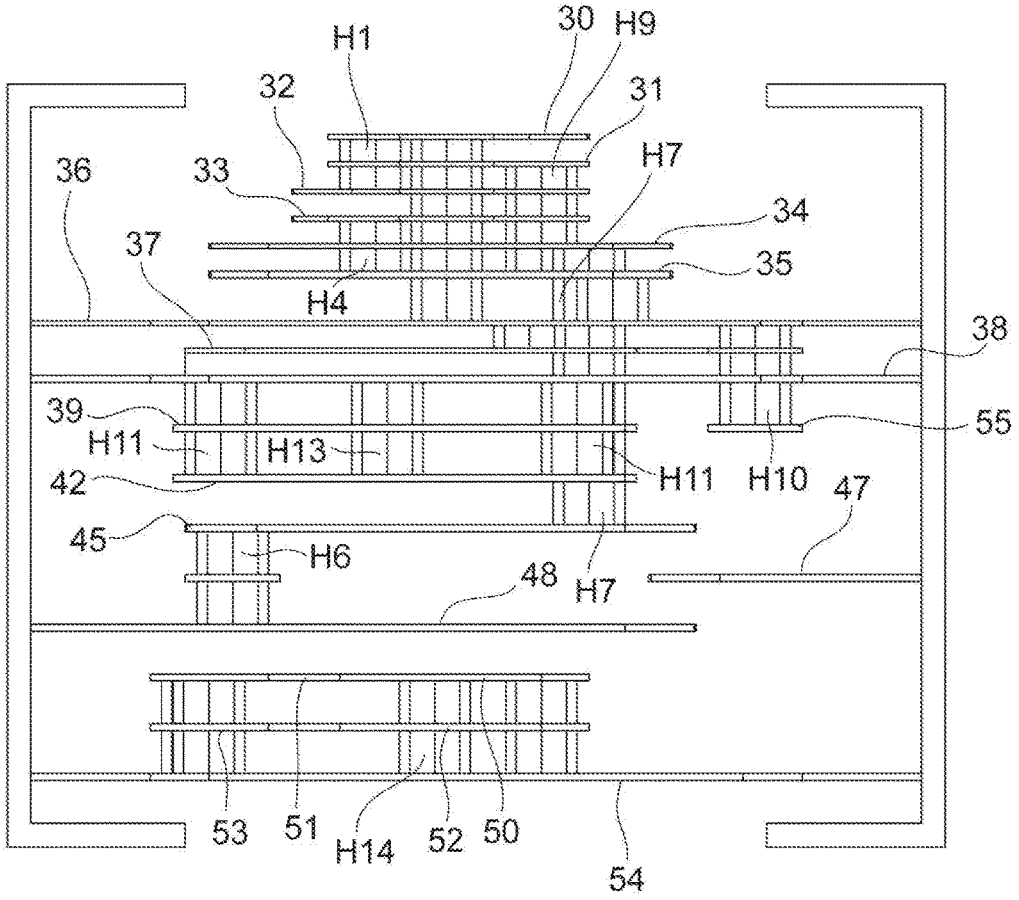
FIG. 7 is a diagram illustrating the internal configuration of the element body from the other end face side.

A conductor layer 45 and a conductor layer 46 are formed on the insulator layer 27*m*. A conductor layer 48 and a conductor layer 49 are formed on the insulator layer 27*o*. The conductor layer 45 and the conductor layer 48 constitute the first sub line 7. The conductor layer 45 and the conductor layer 48 are electrically connected to each other via a through-hole conductor H6 as illustrated in FIG. 7. One end of the conductor layer 45 is electrically connected to the conductor layer 34 via a through-hole conductor H7 as illustrated in FIG. 4. The through-hole conductor H7 constitutes the connection line (the first line) connecting the first sub line 7 and the phase control circuit 9 to each other. The through-hole conductor H7 extends in the stacking direction. One end of the conductor layer 45 constitutes the second end 7*b* of the first sub line 7. One end of the conductor layer 48 is electrically connected to the fourth terminal electrode 24 (the coupling port 4). One end of the conductor layer 48 constitutes the first end 7*a* of the first sub line 7.

Figure 6:
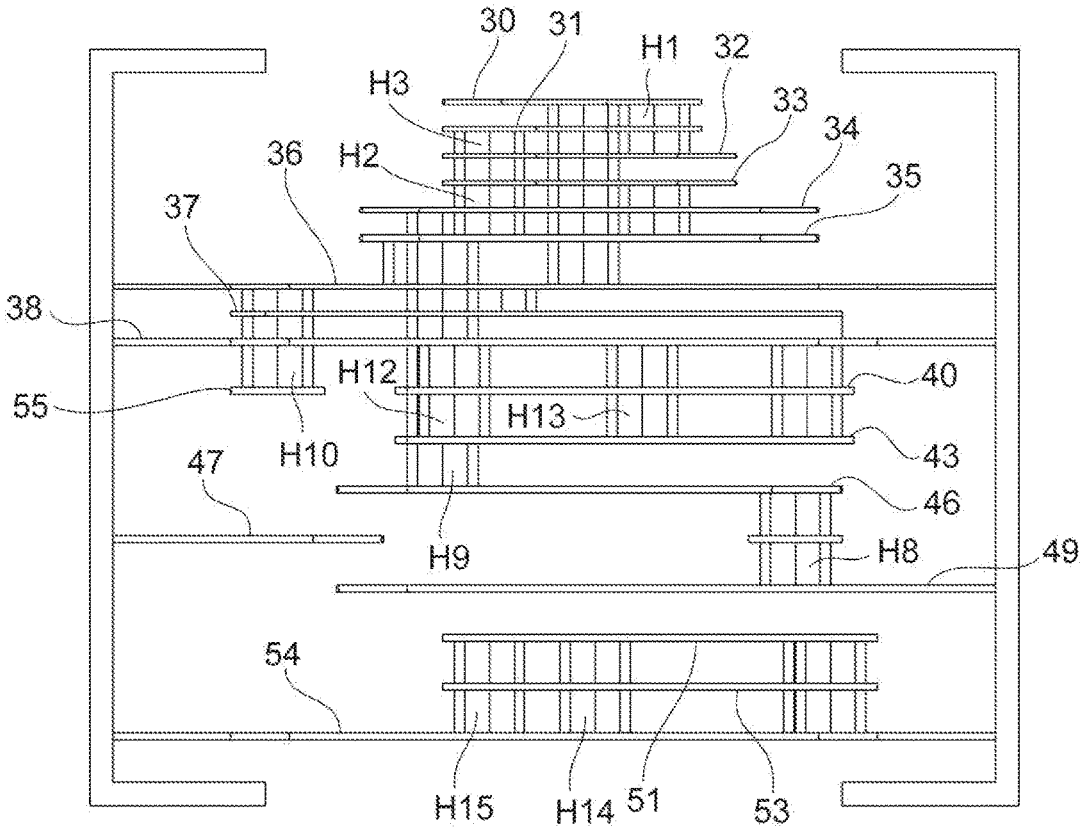
FIG. 6 is a diagram illustrating the internal configuration of the element body from one end face side.

The conductor layer 46 and the conductor layer 49 constitute the second sub line 8. The conductor layer 46 and the conductor layer 49 are electrically connected to each other via a through-hole conductor H8. One end of the conductor layer 46 is electrically connected to the conductor layer 31 via a through-hole conductor H9 as illustrated in FIG. 6. The through-hole conductor H9 constitutes the connection line (the second line) connecting the second sub line 8 and the phase control circuit 9 to each other. The through-hole conductor H9 extends in the stacking direction. One end of the conductor layer 46 constitutes the second end 8*b* of the second sub line 8. One end of the conductor layer 49 is electrically connected to the sixth terminal electrode 26. One end of the conductor layer 49 constitutes the first end 8*a* of the second sub line 8.

Figure 5:
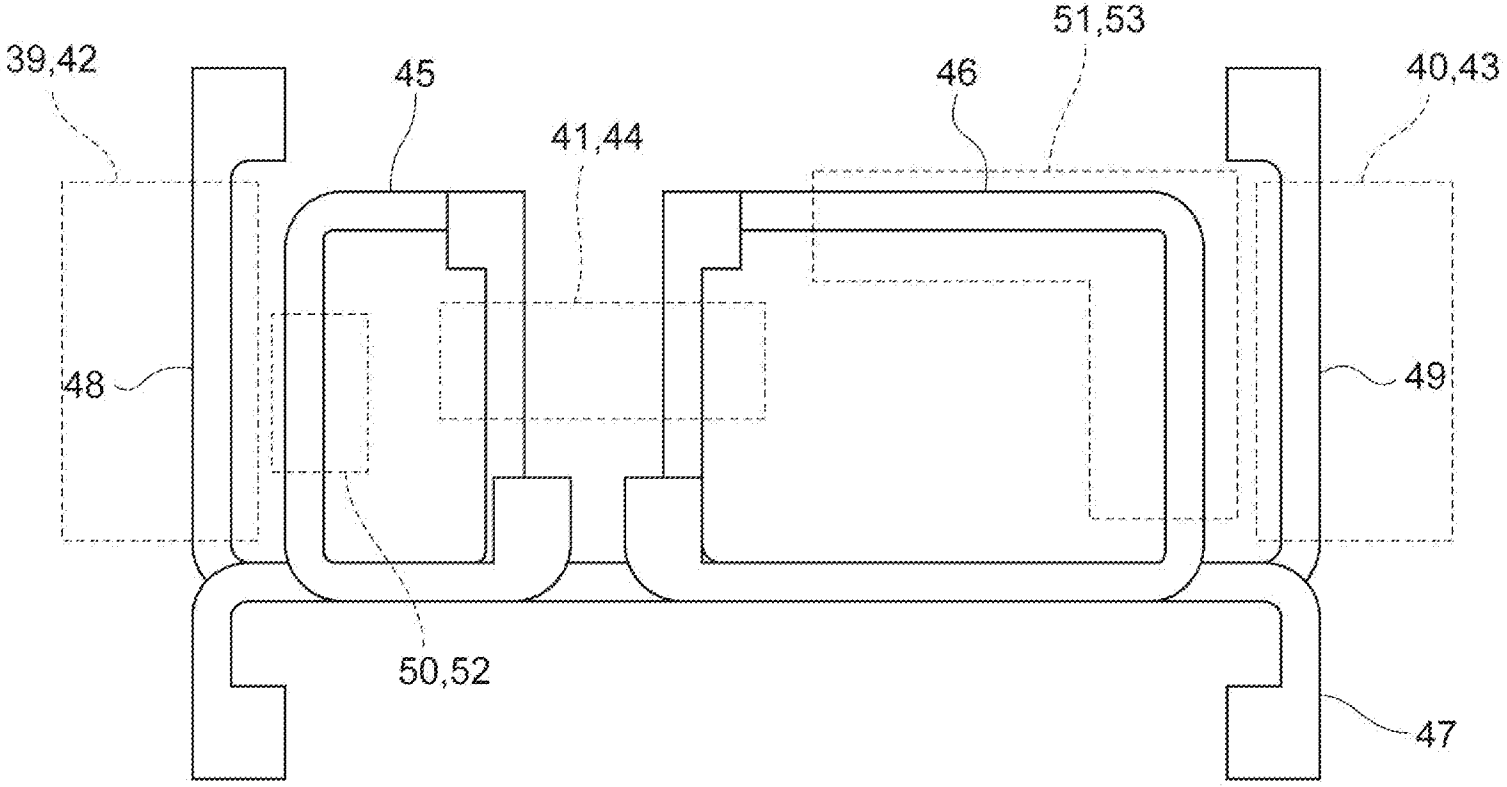
FIG. 5 is a diagram illustrating a part of a conductor layer viewed in a stacking direction.

The conductor layers 45 and 48 and the conductor layers 46 and 49 are disposed at positions which interpose the conductor layer 47 therebetween in the stacking direction. As illustrated in FIG. 5, the conductor layer 45 and the conductor layer 48 are disposed at positions at which parts thereof overlap the conductor layer 47 in the stacking direction. The conductor layer 46 and the conductor layer 49 are disposed at positions at which parts thereof overlap the conductor layer 47. The overlapping parts of the conductor layer 45, the conductor layer 48, and the conductor layer 47 constitute the first coupling portion 10A. That is, the part of the conductor layer 47 overlapping the conductor layer 45 and the conductor layer 48 constitutes the first portion 6A. The overlapping parts of the conductor layer 46, the conductor layer 49, and the conductor layer 47 constitute the second coupling portion 10B. That is, the part of the conductor layer 47 overlapping the conductor layer 46 and the conductor layer 49 constitutes the second portion 6B.

A conductor layer 38 is formed on the insulator layer 27*j*. A conductor layer 54 is formed on the insulator layer 27*r*. The conductor layer 38 and the conductor layer 54 are disposed to face each other at positions which interpose the conductor layer 45, the conductor layer 46, the conductor layer 47, the conductor layer 48, and the conductor layer 49 therebetween in the stacking direction. That is, the conductor layer 38 and the conductor layer 54 are disposed to face each other at positions which interpose the main line 6, the first sub line 7, and the second sub line 8 therebetween in the stacking direction. The conductor layer 38 and the conductor layer 54 are electrically connected to the second terminal electrode 22 (the ground G) and the fifth terminal electrode 25 (the ground G), respectively. The conductor layer 38 and the conductor layer 54 constitute the ground layer.

A cutout portion 38*a* is formed in the conductor layer 38. The through-hole conductor H7 and the through-hole conductor H9 are formed in an area defined by the cutout portion 38*a*.

As illustrated in FIG. 3, a conductor layer 39, a conductor layer 40, and a conductor layer 41 are formed on the insulator layer 27*k*. The conductor layer 55 is formed on the insulator layer 27*k*. The conductor layer 55 is electrically connected to the conductor layer 38 via a plurality of (four herein) through-hole conductors H10 as illustrated in FIG. 4.

As illustrated in FIG. 3, a conductor layer 42, a conductor layer 43, and a conductor layer 44 are formed on the insulator layer 27*l*. The conductor layer 39 and the conductor layer 42 are disposed to face each other in the stacking direction with the insulator layer 27*k* interposed therebetween. The conductor layer 39 and the conductor layer 42 are electrically connected to the conductor layer 38 via a plurality of (two herein) through-hole conductors H11 as illustrated in FIG. 4. That is, the conductor layer 39 and the conductor layer 42 are electrically connected to the ground G.

The conductor layer 40 and the conductor layer 43 are disposed to face each other in the stacking direction with the insulator layer 27*k* interposed therebetween. The conductor layer 40 and the conductor layer 43 are electrically connected to the conductor layer 38 via a plurality of (two herein) through-hole conductors H12. That is, the conductor layer 40 and the conductor layer 43 are electrically connected to the ground G. The conductor layer 41 and the conductor layer 44 are disposed to face each other in the stacking direction with the insulator layer 27*k* interposed therebetween. The conductor layer 41 and the conductor layer 44 are electrically connected to the conductor layer 38 via a through-hole conductor H13. That is, the conductor layer 41 and the conductor layer 44 are electrically connected to the ground G.

The conductor layer 39 and the conductor layer 42 are disposed at positions which overlap the conductor layer 48 in the stacking direction. Specifically, as illustrated in FIG. 5, the conductor layer 39 and the conductor layer 42 are disposed at positions in the stacking direction which overlap a part of the conductor layer 48 not overlapping the conductor layer 47 in the stacking direction. The conductor layer 42 faces the conductor layer 48 with the insulator layers 27*l* to 27*n* interposed therebetween.

The conductor layer 40 and the conductor layer 43 are disposed at positions which overlap the conductor layer 49 in the stacking direction. Specifically, as illustrated in FIG. 5, the conductor layer 40 and the conductor layer 43 are disposed at positions in the stacking direction which overlap a part of the conductor layer 49 not overlapping the conductor layer 47 in the stacking direction. The conductor layer 43 faces the conductor layer 49 with the insulator layers 27*l* to 27*n* interposed therebetween.

The conductor layer 41 and the conductor layer 44 are disposed at positions overlapping the conductor layer 48 and the conductor layer 49 in the stacking direction. Specifically, as illustrated in FIG. 5, the conductor layer 41 and the conductor layer 44 are disposed at positions in the stacking direction which overlap parts of the conductor layer 48 and the conductor layer 49 not overlapping the conductor layer 47 in the stacking direction. The conductor layer 44 faces the conductor layer 48 and the conductor layer 49 with the insulator layers 27*l* to 27*n* interposed therebetween.

A conductor layer 50 and a conductor layer 51 are formed on the insulator layer 27*p*. A conductor layer 52 and a conductor layer 53 are formed on the insulator layer 29*q*. The conductor layer 50 and the conductor layer 52 are disposed to face each other in the stacking direction with the insulator layer 27*p* interposed therebetween. The conductor layer 50 and the conductor layer 52 are electrically connected to the conductor layer 54 via a through-hole conductor H14. That is, the conductor layer 50 and the conductor layer 52 are electrically connected to the ground G.

The conductor layer 51 and the conductor layer 53 are disposed to face each other in the stacking direction with the insulator layer 27*p* interposed therebetween. The conductor layer 51 and the conductor layer 53 are electrically connected to the conductor layer 54 via a plurality of (three herein) through-hole conductors H15. That is, the conductor layer 51 and the conductor layer 53 are electrically connected to the ground G.

The conductor layer 50 and the conductor layer 52 are disposed at positions overlapping the conductor layer 45 in the stacking direction. Specifically, as illustrated in FIG. 5, the conductor layer 50 and the conductor layer 52 are disposed at positions in the stacking direction which overlap a part of the conductor layer 45 not overlapping the conductor layer 47 in the stacking direction. The conductor layer 50 is disposed to face the conductor layer 45 with the insulator layers 27*m* to 27*o* interposed therebetween.

The conductor layer 51 and the conductor layer 53 are disposed at positions overlapping the conductor layer 46 in the stacking direction. Specifically, as illustrated in FIG. 5, the conductor layer 51 and the conductor layer 53 are disposed at positions in the stacking direction which overlap a part of the conductor layer 46 not overlapping the conductor layer 47 in the stacking direction. The conductor layer 51 is disposed to face the conductor layer 46 with the insulator layers 27*m* to 27*o* interposed therebetween.

Figure 8:
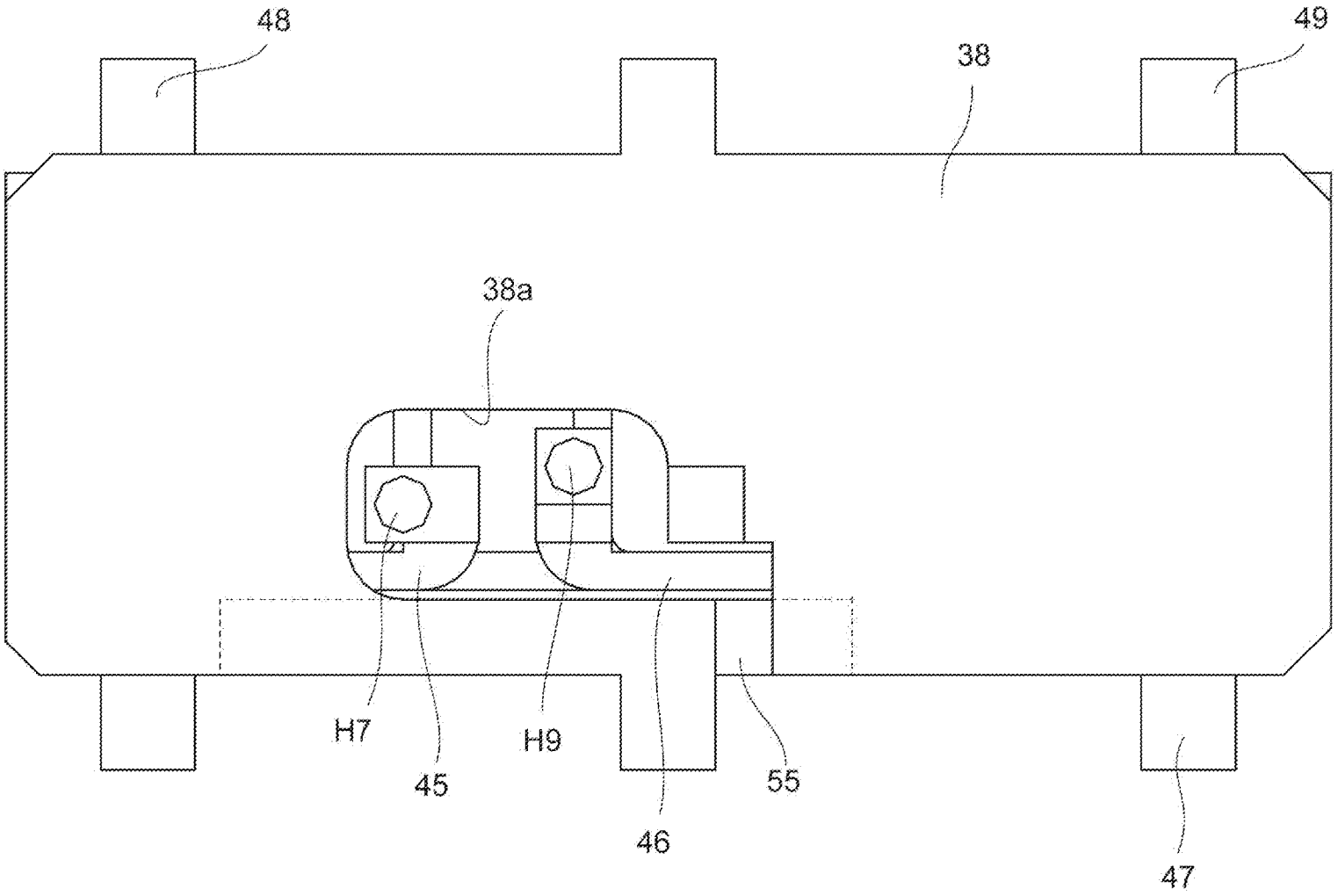
FIG. 8 is a diagram illustrating a part of a conductor layer viewed in the stacking direction.

In this embodiment, the phase control circuit 9 is connected between the first sub line 7 and the second sub line 8 and is disposed at a position at which one ground layer (the conductor layer 38) is interposed between the first sub line 7 and the second sub line 8 in the stacking direction. In this configuration, as illustrated in FIG. 8, the through-hole conductor H7 connecting the first sub line 7 and the phase control circuit 9 to each other and the through-hole conductor H9 connecting the second sub line 8 and the phase control circuit 9 to each other are surrounded by the conductor layer 38 and the conductor layer 55 when viewed in the stacking direction. Specifically, the through-hole conductor H7 and the through-hole conductor H9 are disposed in the area defined by the cutout portion 38*a* of the conductor layer 38. The conductor layer 55 is electrically connected to the conductor layer 38 via the through-hole conductor H10 and has the same potential as the conductor layer 38. The conductor layer 55 is disposed at a position (an overlapping position) facing the conductor layer 38 in the stacking direction. The conductor layer 55 is disposed at a position over an opening of the cutout portion 38*a* of the conductor layer 38 when viewed in the stacking direction.

Figure 9:
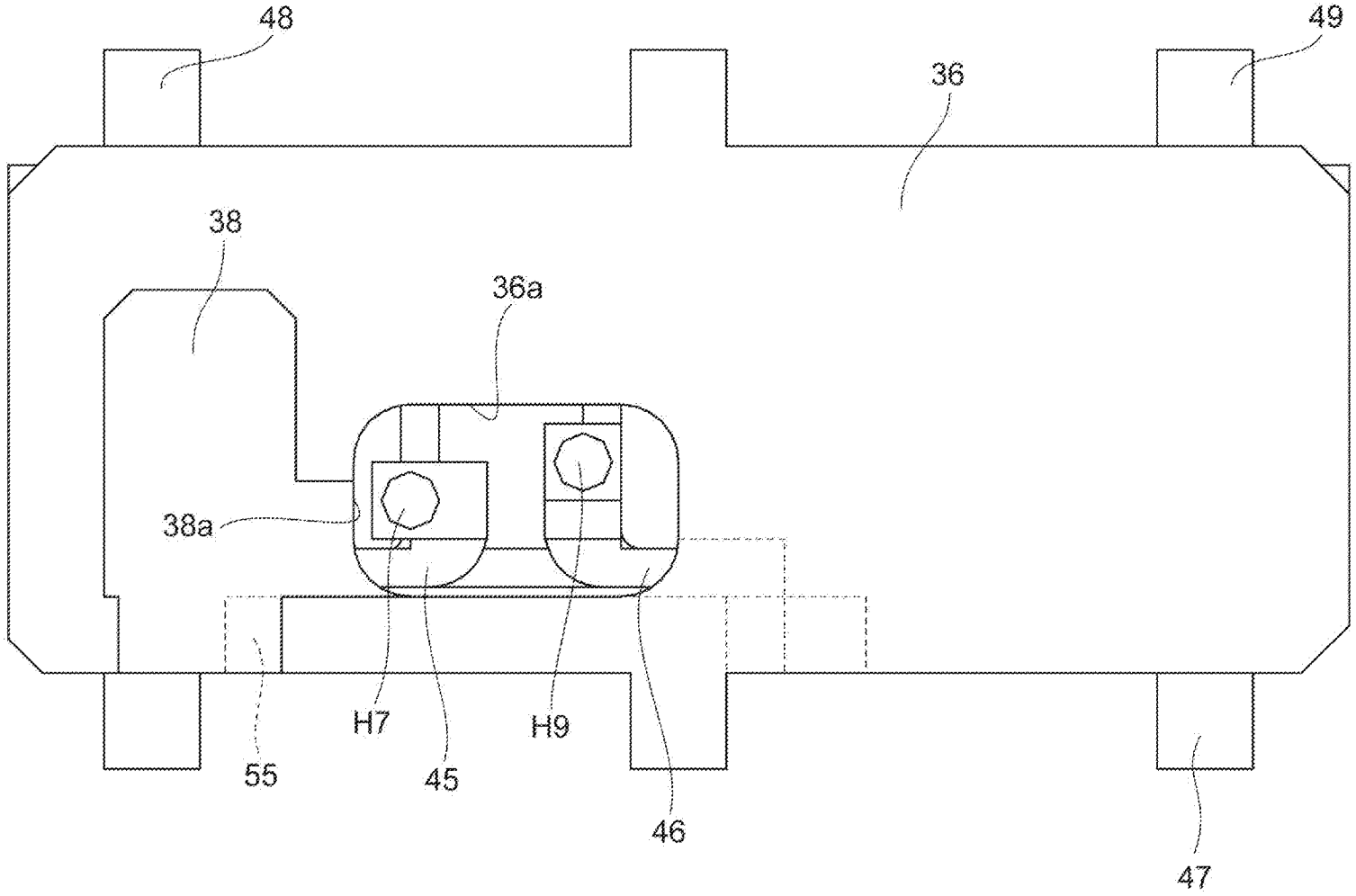
FIG. 9 is a diagram illustrating a part of a conductor layer viewed in the stacking direction.

In this embodiment, as illustrated in FIG. 9, the through-hole conductor H7 and the through-hole conductor H9 are surrounded by the conductor layer 36, the conductor layer 38, and the conductor layer 55 including the conductor layer 36 when viewed in the stacking direction. The conductor layer 36 is electrically connected to the second terminal electrode 22 and the fifth terminal electrode 25 and has the same potential as the conductor layer 38. According to this configuration, the through-hole conductor H7 and the through-hole conductor H9 are surrounded by a plurality of conductor layers in the stacking layer.

As described above, in the stacked coupler 1 according to this embodiment, the through-hole conductor H7 and the through-hole conductor H9 are surrounded by the conductor layer 38 and the conductor layer 55 when viewed in the stacking direction. Accordingly, in the stacked coupler 1, it is possible to prevent a difference in impedance from being generated in the through-hole conductor H7 and the through-hole conductor H9. Accordingly, in the stacked coupler 1, it is possible to achieve improvement in isolation characteristics.

Figure 10:
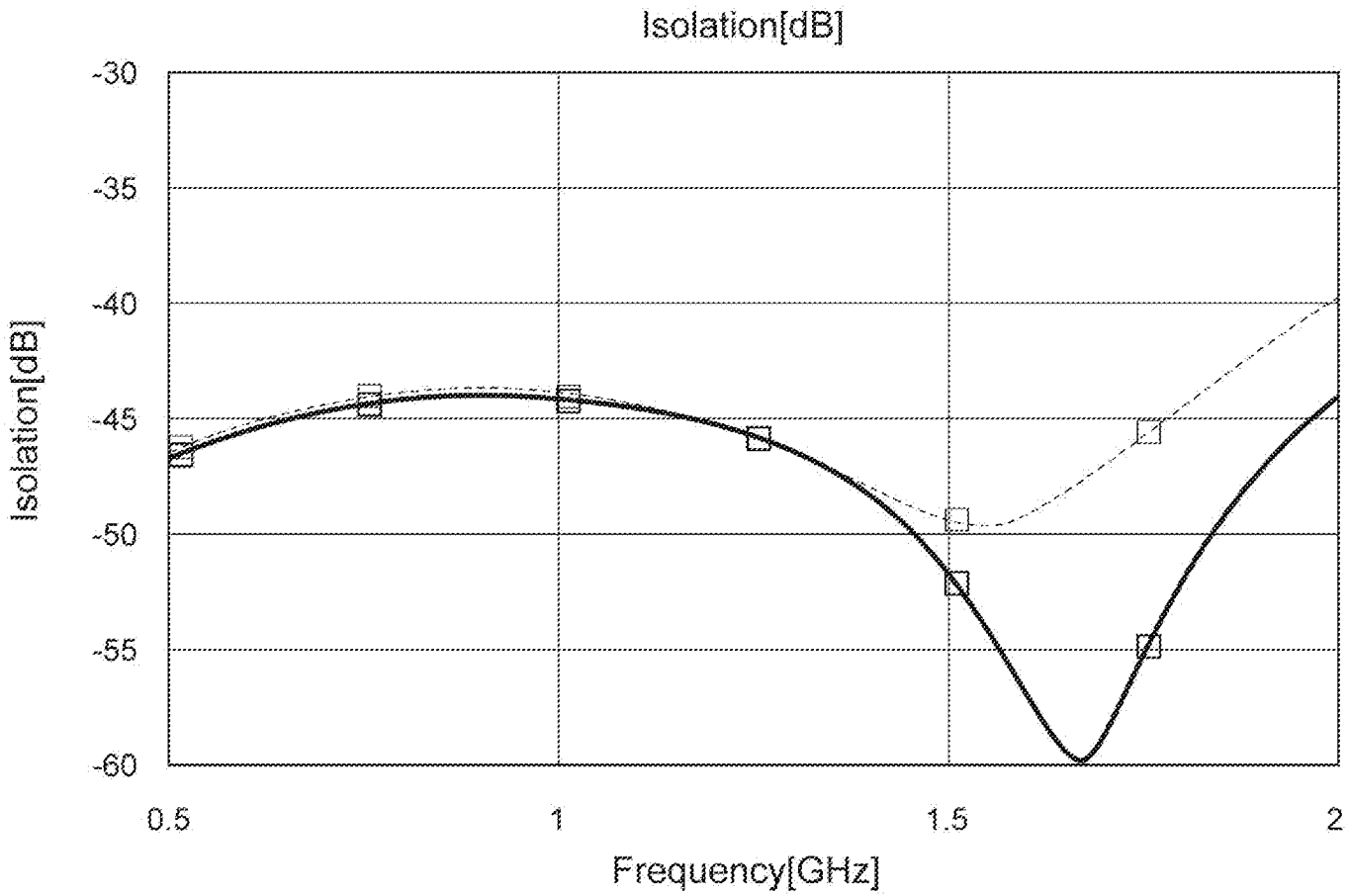
FIG. 10 is a diagram illustrating isolation characteristics.

In FIG. 10, a solid line indicates isolation characteristics of the stacked coupler 1 according to this embodiment. That is, the solid line indicates isolation characteristics in a configuration in which the connection line is surrounded by the ground layer. A dotted line indicates isolation characteristics of the stacked coupler according to a comparative example. That is, the dotted line indicates isolation characteristics in a configuration in which the connection line is not surrounded by the ground layer. In FIG. 10, the horizontal axis represents frequency [GHz] and the vertical axis represents isolation [dB].

As illustrated in FIG. 10, in the stacked coupler 1, since a difference in impedance can be prevented, it is possible to reduce isolation at high frequencies in comparison with a stacked coupler in the related art. Accordingly, in the stacked coupler 1, it is possible to achieve improvement in isolation characteristics.

In the stacked coupler 1 according to this embodiment, the through-hole conductor H7 and the through-hole conductor H9 are surrounded by the conductor layer 36 in addition to the conductor layer 38 and the conductor layer 55 when viewed in the stacking direction. The conductor layer 36, the conductor layer 38, and the conductor layer 55 are disposed at different positions in the stacking direction. In this way, by surrounding the through-hole conductor H7 and the through-hole conductor H9 with a plurality of conductor layers in the stacking direction, it is possible to further prevent a difference in impedance from being generated in the through-hole conductor H7 and the through-hole conductor H9.

In the stacked coupler 1 according to this embodiment, the cutout portion 38*a* is formed in the conductor layer 38. The through-hole conductor H7 and the through-hole conductor H9 are disposed in the area defined by the cutout portion 38*a*. In this configuration, the through-hole conductor H7 and the through-hole conductor H9 is disposed in the area defined by the cutout portion 38*a*, and the through-hole conductor H7 and the through-hole conductor H9 are surrounded by the conductor layer 38 and the conductor layer 55. Accordingly, it is possible to satisfactorily surround the through-hole conductor H7 and the through-hole conductor H9. In this configuration, since the through-hole conductor H7 and the through-hole conductor H9 are disposed in the area defined by the cutout portion 38*a*, the through-hole conductor H7 and the through-hole conductor H9 can be configured to extend in the stacking direction. Accordingly, it is possible to achieve simplification of the configuration of the through-hole conductor H7 and the through-hole conductor H9.

In the stacked coupler 1 according to this embodiment, the connection line includes the through-hole conductor H7 connecting the first sub line 7 and the phase control circuit 9 to each other and the through-hole conductor H9 connecting the second sub line 8 and the phase control circuit 9 to each other. The through-hole conductor H7 and the through-hole conductor H9 are surrounded by the conductor layer 38 and the conductor layer 55 when viewed in the stacking direction. In this configuration, it is possible to further prevent a difference in impedance from being generated in the through-hole conductor H7 and the through-hole conductor H9. Accordingly, it is possible to further achieve improvement in isolation characteristics.

In the stacked coupler 1 according to this embodiment, the conductor layers 39 and 42, the conductor layers 40 and 43, the conductor layers 41 and 44, the conductor layers 50 and 52, and the conductor layers 51 and 53 are disposed in the element body 20. The conductor layers are disposed to face parts in which the main line 6 (the conductor layer conductor layer 47), the first sub line 7 (the conductor layer 45 and the conductor layer 48), and the second sub line 8 (the conductor layer 46 and the conductor layer 49) do not overlap each other in the stacking direction which are parts in which a distance to the ground layer (the conductor layer 38) and a distance to the ground layer (the conductor layer 54) are different in the stacking direction. The conductor layers are disposed at positions at which the distances between the parts and one ground layer or the distance between the parts and the other ground layer are the same. Accordingly, in the stacked coupler 1, it is possible to prevent a difference in impedance from being generated in the parts in which the main line 6, the first sub line 7, and the second sub line 8 do not overlap each other. Accordingly, in the stacked coupler 1, it is possible to achieve improvement in isolation characteristics.

While an embodiment of the invention has been described above, the invention is not limited to the embodiment and can be modified in various forms without departing from the gist of the invention.

In the embodiment, an example in which the through-hole conductor H7 and the through-hole conductor H9 are surrounded by the conductor layer 38 and the conductor layer 55 has been described. However, one of the through-hole conductor H7 and the through-hole conductor H9 may be surrounded by the conductor layer 38 and the conductor layer 55.

In the embodiment, an example in which the conductor layers 39 and 42, the conductor layers 40 and 43, the conductor layers 41 and 44, the conductor layers 50 and 52, and the conductor layers 51 and 53 are disposed in the element body 20 has been described. However, the conductor layers 39 and 42, the conductor layers 40 and 43, the conductor layers 41 and 44, the conductor layers 50 and 52, and the conductor layers 51 and 53 may not be provided. From the viewpoint of improvement in isolation characteristics, it is preferable that the conductor layers be provided.

In the above-mentioned embodiment, an example in which the terminal electrodes 21 to 23 are disposed on the lateral face 20*e* and the principal faces 20*c* and 20*d* and the terminal electrodes 24 to 26 are disposed on the lateral face 20*f* and the principal faces 20*c* and 20*d* has been described above. However, the shapes (arrangement shapes) of the terminal electrodes 21 to 26 are not limited thereto.

What is claimed is:

1. A directional coupler comprising:

an element body that is formed by stacking a plurality of insulator layers; and an input terminal and an output terminal that are disposed on an outer surface of the element body, wherein the element body includes a main line that is connected between the input terminal and the output terminal, a first sub line and a second sub line that are electromagnetically coupled to the main line, a pair of ground layers that are disposed to face each other at positions at which the main line, the first sub line, and the second sub line are interposed in a stacking direction of the plurality of insulator layers, a phase control circuit that is connected between the first sub line and the second sub line and is disposed at a position at which one ground layer is interposed between the first sub line and the second sub line in the stacking direction, and a connection line that connects the first sub line and the second sub line to the phase control circuit, and the connection line is surrounded by at least one of one ground layer and a conductor having the same potential as the ground layer when viewed in the stacking direction.

2. The directional coupler according to claim 1, wherein a plurality of conductors are disposed in the stacking direction.

3. The directional coupler according to claim 1, wherein a cutout portion is formed in one ground layer, and the connection line is disposed in an area which is defined by the cutout portion and is surrounded by the ground layer and the conductor when viewed in the stacking direction.

4. The directional coupler according to claim 1, wherein the connection line includes a first line that connects the first sub line and the phase control circuit to each other and a second line that connects the second sub line and the phase control circuit to each other, and the first line and the second line are surrounded by at least one of one ground layer and a conductor having the same potential as the ground layer.

* * * * *